US006598452B1

(12) United States Patent
Hanke et al.

(10) Patent No.: US 6,598,452 B1
(45) Date of Patent: Jul. 29, 2003

(54) CRIMPING TOOL

(76) Inventors: Wolfgang Hanke, Hans-Thoma-Strasse 7, D-74889 Sinsheim (DE); Paul Fleps, Martin-Luther-Strasse 1, D-74889 Sinsheim (DE)

( * ) Notice: Subject to any disclaimer, the term of this patent is extended or adjusted under 35 U.S.C. 154(b) by 28 days.

(21) Appl. No.: 10/049,338

(22) PCT Filed: Aug. 11, 2000

(86) PCT No.: PCT/DE00/02751

§ 371 (c)(1),
(2), (4) Date: Feb. 11, 2002

(87) PCT Pub. No.: WO01/13474

PCT Pub. Date: Feb. 22, 2001

(30) Foreign Application Priority Data

Aug. 11, 1999 (DE) ..... 199 37 351

(51) Int. Cl.[7] ..... B21J 13/10

(52) U.S. Cl. ..... 72/420; 72/453.02; 72/712; 29/753; 29/863

(58) Field of Search ..... 72/420, 421, 441, 72/453.01, 453.02, 453.07, 453.08, 712; 29/753, 863

(56) References Cited

U.S. PATENT DOCUMENTS

| | | | | |
|---|---|---|---|---|
| 3,800,389 A | | 4/1974 | Brehm et al. | |
| 4,443,936 A | | 4/1984 | Lazaro, Jr. | |
| 4,476,629 A | | 10/1984 | Suzuki et al. | |
| 4,596,072 A | | 6/1986 | Shields | |
| 4,638,549 A | | 1/1987 | Okazaki et al. | |
| 5,440,799 A | * | 8/1995 | Marshall et al. | 29/566.2 |
| 5,752,405 A | * | 5/1998 | Gerst et al. | 72/312 |
| 6,026,562 A | * | 2/2000 | McMillin et al. | 29/748 |
| 6,298,707 B1 | | 10/2001 | Fleps et al. | |

FOREIGN PATENT DOCUMENTS

| | | |
|---|---|---|
| DE | 197 50 770 A1 | 6/1999 |
| EP | 0 802 589 A1 | 10/1997 |

* cited by examiner

*Primary Examiner*—Ed Tolan
(74) *Attorney, Agent, or Firm*—Alston & Bird LLP

(57) ABSTRACT

A crimping tool for crimping crimp contacts, in particular crimp contacts which are supplied to the crimping tool in the form of a strip, having a pressing device (1) and a feed device (2) for advancing the crimp contacts to the pressing device (1). The feed device (2) comprises an advancing element (3) and means (4) for reciprocating the advancing element (3), so as to provide a reliable supply of crimp contacts to the pressing device (1) in a constructionally simple manner. The means (4) for reciprocating the advancing element (3) comprises two cylinder-piston arrangements (5,6), which are independent of each other.

15 Claims, 4 Drawing Sheets

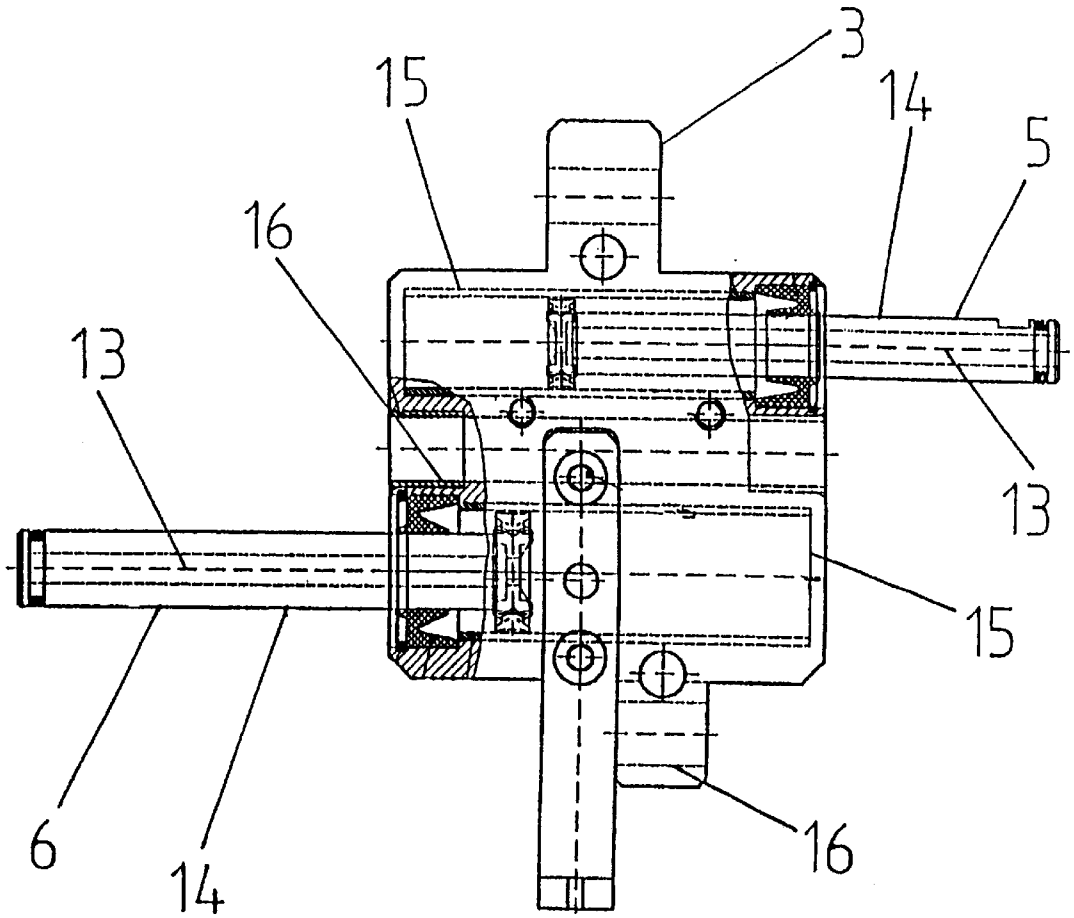
Fig. 2
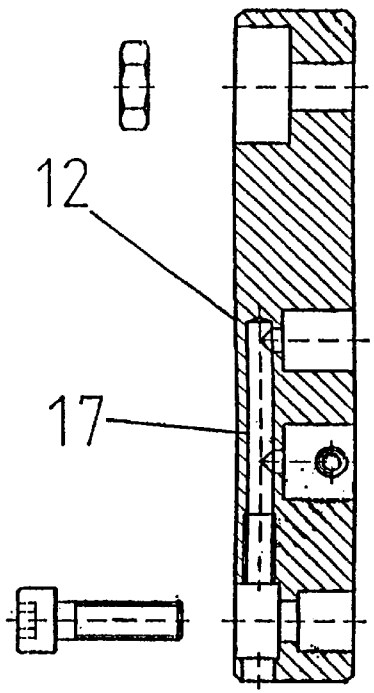

CRIMPING TOOL

BACKGROUND OF THE INVENTION

The invention relates to a crimping tool for crimping crimp contacts, in particular crimp contacts which are supplied to the crimping tool in the form of a strip, with a pressing device and a feed device for advancing the crimp contacts to the pressing device, the feed device comprising an advancing element and means for reciprocating the advancing element.

Crimping tools of the described type have been known from practice for a long time, and they exist in a large variety of designs. The known crimping tools are designed and constructed for a streamlined processing of crimp contacts in the form of a strip, in a longitudinal or transverse movement, or for sortable individual contacts. Frequently, the known crimping tools are designed and constructed as quick-change tools, and they can be used in individual workstations or fully automatic machines and transfer lines. In this connection, it is possible to handle electric conductors with a cross sectional area from about 0.08 $mm^2$ to 50 $mm^2$.

A crimping tool of the initially described type is known, for example, from DE 197 50 770 A1. The known crimping tool comprises a feed device with an advancing element, which advances the crimp contacts, via a feed finger arranged on the advancing element, to the pressing device and in particular to a crimping stamp of the pressing device. With respect to a stable and precise crimping, it is necessary that the crimp contacts be fed exactly and reliably to the pressing device in alignment with the position of the crimping stamp. To this end, the feed device includes means for reciprocating the advancing element. The means comprise a pneumatic drive, which includes two piston rods in alignment and in contact with each other, or even made in one piece. The piston rods are adapted for movement relative to a common cylinder, which is formed in the advancing element. During a normal reciprocation of the advancing element, the piston rods remain stationary, whereas the advancing element moves along with the cylinder. Each of the piston rods accommodates a channel for suppliable compressed air, which extends from the exterior of the crimping tool into the cylinder.

The known crimping tool is problematic in that the cylinder bottom surface, which is decisive for the force transmission of the cylinder-piston arrangement, is clearly limited by the presence of the piston rod. This results in that, frequently, the force transmission and, thus, the advancing step do not suffice to pull down the contacts from a spool holding a strip of crimp contacts and over a safety brake with the required safety or required safety reserve. This may result in a faulty supply of crimp contacts to the pressing device, which in turn results in imperfect crimp connections.

It is therefore an object of the present invention to describe a crimping tool of the initially described type, which permits with constructionally simple means a reliable supply of crimp contacts to the pressing device.

Summary of the Invention

The above and other objects and advantages of the invention are achieved by the provision of a crimping tool which comprises a pressing device which is mounted to a base body, and a feed device which includes an advancing element which is mounted for reciprocation so as to advance the strip of crimp contacts. Means are provided for reciprocating the advancing element which include two cylinder-piston arrangements, which are independent of each other.

In a way according to the invention, it has been recognized that the foregoing object is achieved in a surprisingly simple manner by providing two cylinder-piston arrangements, which are independent of each other. To this end, a separate cylinder is associated with each cylinder-piston arrangement. This in turn results in the advantage that the bottom surface of the cylinder, which is decisive for the force transmission, is not limited in its size by any components. Thus, with an ultimately identically dimensioned construction of a system for supplying a flowable medium to the cylinder-piston arrangements, it is possible to produce a substantially greater pushing force for the advancing element.

Consequently, the crimping tool of the present invention realizes a crimping tool, which permits with constructionally simple means a reliable supply of crimp contacts to the pressing device.

As regards a reliable guidance of the advancing element during its reciprocation, it would be possible to guide the advancing element by the two cylinder-piston arrangements at the same time. This would prevent the advancing element from tilting relative to the pressing device.

A particularly stable movement of the advancing element could be ensured by arranging the main axes of the cylinder-piston arrangements along a line, thereby avoiding tilting moments of the advancing element relative to the feed device and the pressing device. The main axis of the cylinder-piston arrangement extends in the center and in the longitudinal direction of the piston and the cylinder.

To realize a particularly compact crimping tool or a particularly compact feed device, it would be possible to arrange the main axes of the cylinder-piston arrangements in offset relationship with each other. In such a realization, the cylinder-piston arrangements could extend in part parallel to each other.

In particular, in the case of an offset placement of the cylinder-piston arrangements, it would be possible to place one of the cylinder-piston arrangements in the lower portion and the other cylinder-piston arrangement in the upper portion of the advancing element. With that, the cylinder-piston arrangements could quasi overlie each other.

The pistons of the cylinder-piston arrangements could include piston rods. In this instance, the advancing element would be guided on the pistons or piston rods. In a corresponding manner, it would be possible to arrange the cylinders of the cylinder-piston arrangements in the advancing element. In this connection, it is possible to realize the cylinders as cutouts in the advancing element.

The reciprocation of the advancing element could require different pushing forces. In particular, the movement of the advancing element in the direction toward the pressing device, which ensures the feed of the crimping contacts, could require a greater pushing force than the movement in the direction away from the pressing device. In a corresponding manner, the cylinder-piston arrangement for moving the advancing element in the direction toward the pressing device, could have a larger diameter than the other cylinder-piston arrangement. This could show in the diameter of the piston and the cylinder.

As regards a particularly reliable guidance of the advancing element during its reciprocation, it would be possible to provide for the advancing element at least one guide element. In this connection, the guide element could be a rod extending through a passageway in the advancing element. According to requirements, the rod could basically be arranged between the two cylinder-piston arrangements.

However, an arrangement above or below or laterally of the two cylinder-piston arrangements is also possible.

With respect to a particularly compact construction of the crimping tool, the guide element could perform a double function to the extent that it is designed and constructed on the one hand for guiding the advancing element, and on the other hand for supplying a flowable medium. To this end, the guide element or rod could be constructed with a channel or made tubular for purposes of supplying one cylinder-piston arrangement with a flowable medium. With that, it would be possible to supply one cylinder-piston arrangement or both cylinder piston arrangements with a flowable medium. As a flowable medium, it is preferred to use compressed air. However, other liquid or gaseous media are also possible, such as for example oil.

To ensure a safe and reliable operation of the crimping tool, the supply of the cylinder-piston arrangements could be controllable with a flowable medium via a control unit. The control unit could include a valve system, which supplies the medium originating from a source to the cylinder-piston arrangements in a suitable manner.

In a particularly practical manner, the pistons or the piston rods could be made tubular for purposes of directing a flowable medium into the respective cylinder.

In a particularly practical manner, it would be possible to couple the control unit with the pressing device in a functional manner. This means that the control unit and thus the movement of the advancing element are controlled in accordance with the working position of the pressing device. As a result, the operation of the pressing device is coupled with the supply operation for the crimping contacts. The coupling could occur via the movement of the crimping stamp associated with the pressing device, which controls by its movement the control unit via a cam.

There exist various possibilities of improving and further developing the teaching of the present invention in an advantageous manner. To this end, reference may be made to the following detailed description of a preferred embodiment of the invention with reference to the drawing. In conjunction with the description of the preferred embodiment of the invention with reference to the drawing, also generally preferred improvements and further developments of the teaching are described.

BRIEF DESCRIPTION OF DRAWINGS

FIG. 2 is a front view, partially sectioned, which shows on the right an advancing element and on the left a connecting part for the advancing element of FIG. 1;

DETAILED DESCRIPTION OF THE PREFERRED EMBODIMENTS

Figure 1:
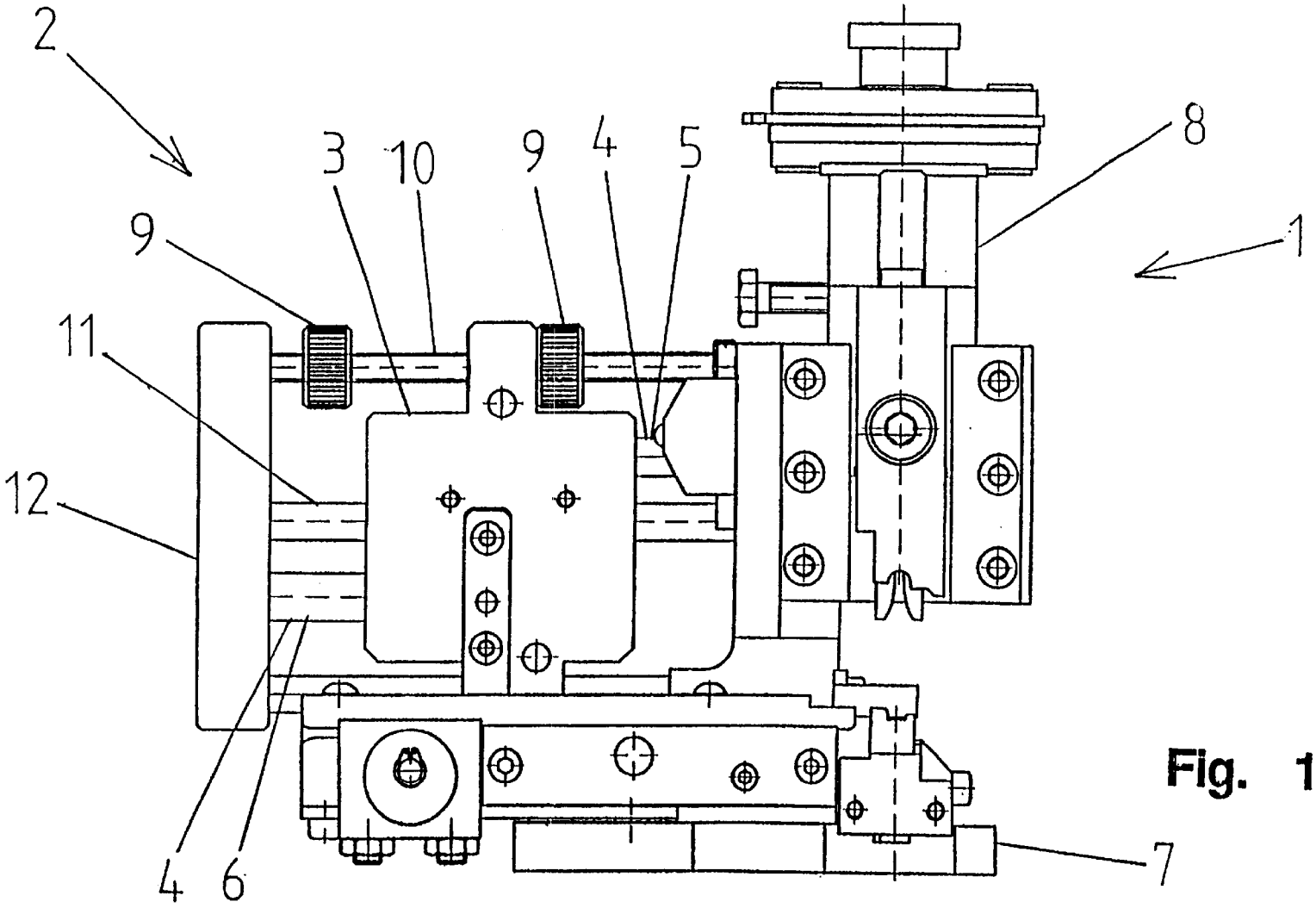
FIG. 1 is a front view of the embodiment of a crimping tool in accordance with the invention.

FIG. 1 is a front view of the embodiment of a crimping tool according to the invention for crimping crimp contacts. The crimping tool includes a pressing device 1 and a feed device 2 for supplying the crimp contacts to the pressing device 1. The feed device 2 includes an advancing element 3 and means 4 for reciprocating the advancing element 3. The means 4 for reciprocating the advancing element 3 comprise two cylinder-piston arrangements 5, 6 independent of each other, which permit with constructionally simple means a reliable supply of crimp contacts to the pressing device 1.

Furthermore, the crimping tool includes a base body 7, with which the pressing device 1 and the feed device 2 are associated. The pressing device 1 includes a crimping stamp 8, which is adapted for movement in the vertical direction.

The movement of advancing element 3 is limited by two stops 9. The stops 9 are formed by knurled nuts, which are arranged on a threaded rod 10 that is used at the same time for guiding the advancing element 3. Furthermore, for guiding the advancing element 3, a rod 11 is provided, which is made tubular for supplying the cylinder-piston arrangement 6 with compressed air. The compressed air is supplied through base body 7, rod 11, a connecting part 12, and a tubular piston of the cylinder-piston arrangement 6, into the cylinder of the cylinder-piston arrangement 6. The cylinder-piston arrangement 5 receives the flowable medium, via base the body 7 and the piston of cylinder-piston arrangement 5, which may be made tubular or with a channel. Basically, both pistons and/or piston rods of the cylinder-piston arrangements 5 and 6 may be made tubular or with a corresponding channel for the flowable medium. This permits an elegant supply of the medium to the respective cylinder of the cylinder-piston arrangements 5 and 6.

In a partially sectioned front view, FIG. 2 illustrates the advancing element 3 in the right portion of the Figure and a connecting part 12 for the advancing element 3 in the left portion of the Figure. The placement of the cylinder-piston arrangements 5 and 6 is best seen in this Figure. The main axes 13 of the cylinder-piston arrangements 5 and 6 extend in offset relationship with each other.

The pistons of the cylinder-piston arrangements 5 and 6 include each a piston rod 14. The cylinders 15 of the cylinder-piston arrangements 5 and 6 are formed in the advancing element 3.

The upper cylinder-piston arrangement 5 is dimensioned smaller or has a smaller diameter than the cylinder-piston arrangement 6 in the lower portion of advancing element 3. This ensures that in the device for feeding the crimp contacts to the pressing device 1, an adequate force is made available for unwinding the crimp contacts from their spool.

As regards a safe guidance of the advancing element 3, the advancing element 3 includes passageways 16 for guide elements. For example, the rod 11 of FIG. 1 extends through the passageway 16 in the center.

The left portion of FIG. 2 shows the connecting part 12 for the advancing element 3. The connecting part 12 accommodates a channel 17, which guides the flowable medium from the rod 11 into the piston rod 14 of the cylinder-piston arrangement 6.

Figure 3:
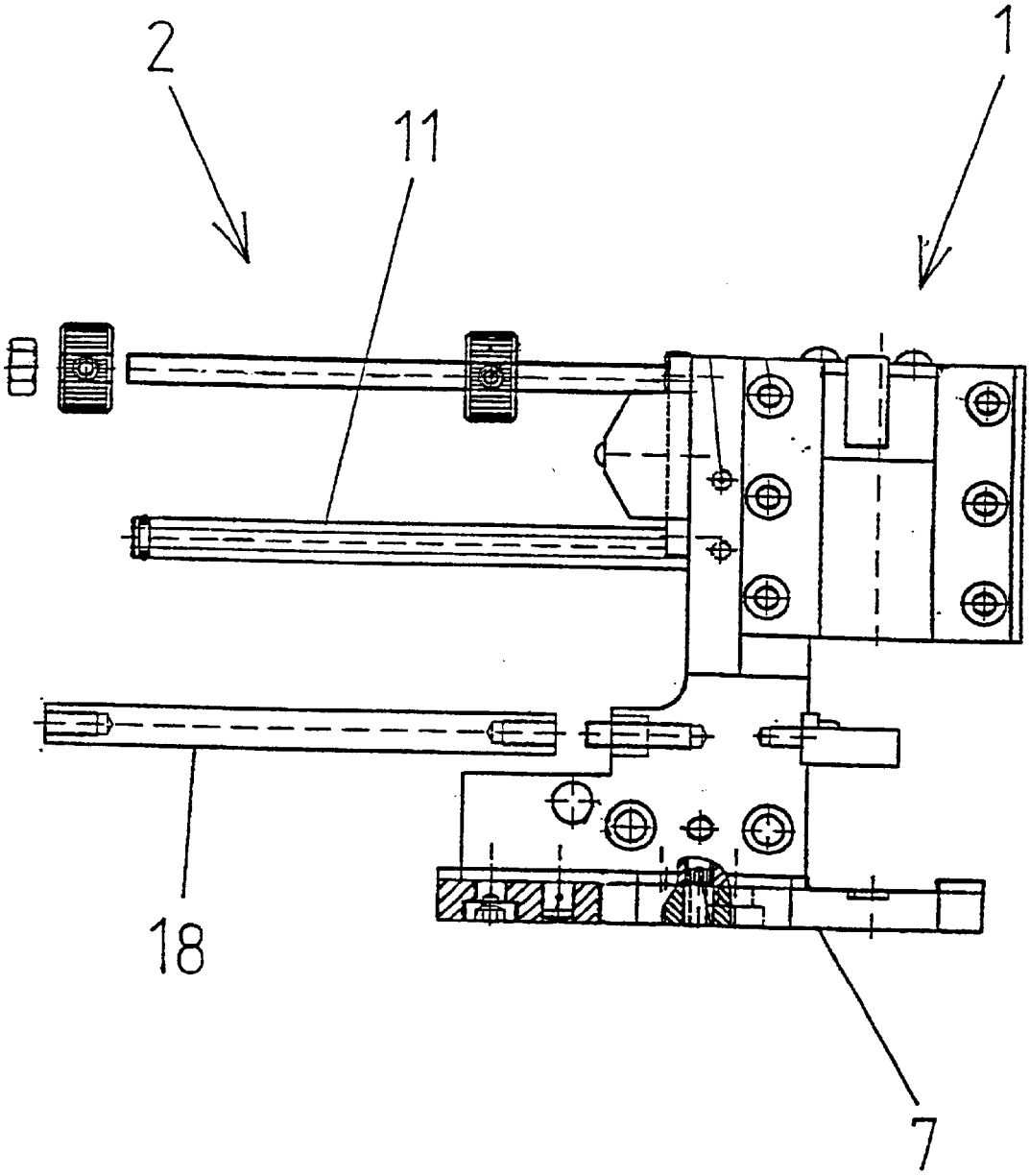
FIG. 3 is a front view, partially sectioned, of a base body of the embodiment of FIG. 1.

In a partially sectioned front view, FIG. 3 shows the base body 7 of FIG. 1. The pressing device 1 is shown without crimping stamp 8, and the feed device 2 without advancing element 3. The rod 11 extends into the base body 7, where it is coupled with a control unit for controlling the supply of the flowable medium. The lower portion of the base body 7 also accommodates a further guide rod 18.

Figure 4:
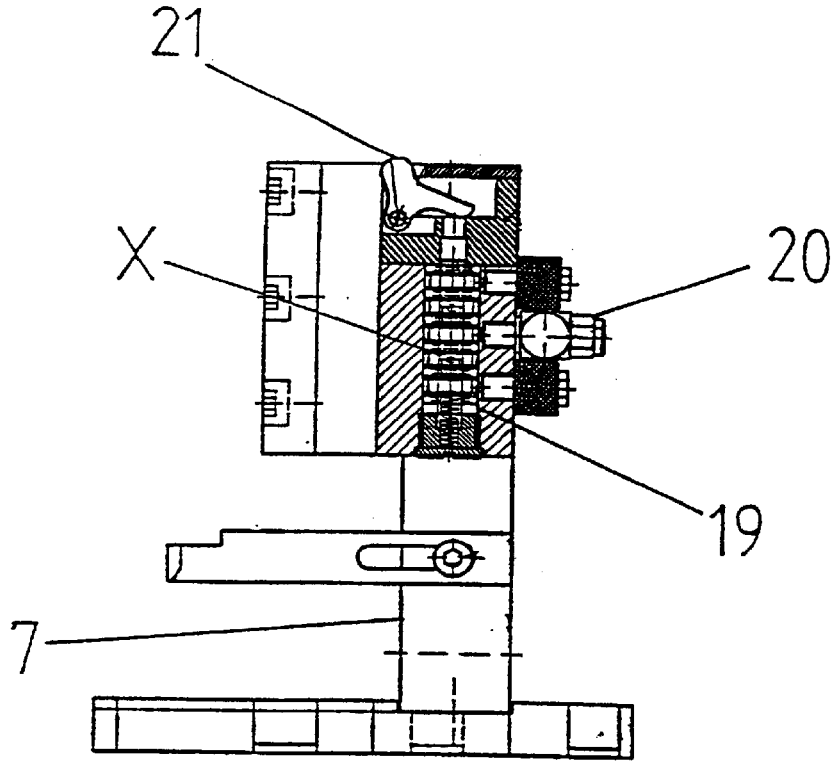
FIG. 4 is a side view, partially sectioned, which shows above the base body and below a control unit of the embodiment of FIG. 1.
Figure 4:
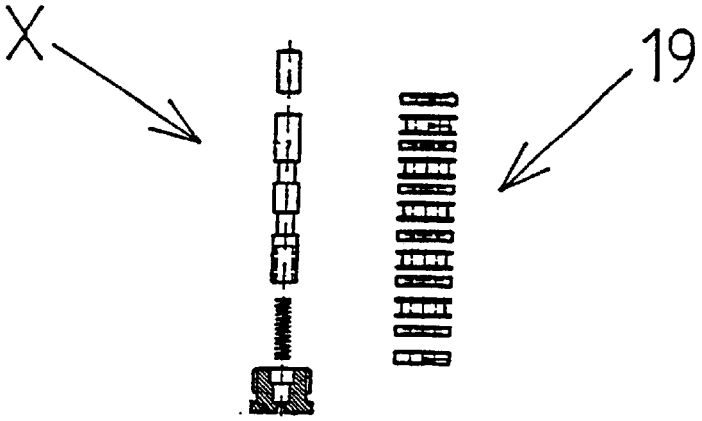

In a partially sectioned side view, FIG. 4 illustrates above the base body 7 and below in detail the control unit 19. The illustration of base body 7, visualizes the arrangement of control unit 19 in the base body 7. Via a compressed-air connection 20, the control unit 19 receives compressed air, which is subsequently supplied in accordance with the working position of crimping stamp 8 to the cylinder-piston arrangements 5 and 6. In this process, the control unit 19 is controlled via a cam 21, which can be moved via crimping stamp 8.

The lower portion of FIG. 4 illustrates in detail the control unit 19 of the crimping tool. The arrangement of control unit 19 in the base body 7 is indicated by the letter X. In FIG. 4, the base body 7 is shown from the right side of the crimping tool of FIG. 1.

A regards further advantageous improvements and further developments of the teaching according to the present invention, the general part of the specification on the one hand and the attached claims on the other are herewith incorporated by reference for purposes of avoiding repetitions.

Finally, it should be expressly emphasized that the foregoing, merely arbitrarily selected embodiment is used only for explaining the teaching of the present invention, without however limiting same to this embodiment.

What is claimed is:

1. A crimping tool for crimping crimp contacts which are supplied to the crimping tool in the form of a strip, comprising a pressing device which is mounted to a base body for vertical reciprocation, a feed device mounted to the base body for supplying the crimp contacts to the pressing device and including an advancing element, and means for reciprocating the advancing element which includes two cylinder-piston arrangements, which are independent of each other and have main axes which are arranged in a parallel and offset relationship with respect to each other.

2. The crimping tool of claim 1, wherein the cylinder-piston arrangements are arranged to extend from respective opposite sides of the advancing element.

3. The crimping tool of claim 1, wherein one of the cylinder-piston arrangements is disposed in a lower portion of the advancing element, and the other cylinder-piston arrangement is disposed in an upper portion of the advancing element.

4. The crimping tool of claim 3, wherein the cylinder-piston arrangements are positioned one above the other.

5. The crimping tool of claim 1, wherein each of the cylinder-piston arrangements includes a piston rod along which the advancing element is guided for movement.

6. The crimping tool of claim 1, wherein the cylinder-piston arrangements each include a cylinder which is arranged in the advancing element.

7. The crimping tool of claim 1, wherein one cylinder-piston arrangement has a larger diameter than the other cylinder-piston arrangement.

8. The crimping tool of claim 1, further comprising at least one guide element for guiding the reciprocation of the advancing element.

9. The crimping tool of claim 8, wherein the one guide element is a rod mounted to the base body and extending through a passageway in the advancing element.

10. The crimping tool of claim 9, wherein the rod is arranged substantially between the two cylinder-piston arrangements.

11. The crimping tool of claim 9, wherein the rod is made tubular for supplying one cylinder-piston arrangement with a pressurized fluid.

12. The crimping tool of claim 1, wherein each of the cylinder-piston arrangements includes a cylinder formed in the advancing element and a piston rod fixedly mounted to the base body and disposed within the respective cylinder for sliding movement therein.

13. The crimping tool of claim 12, wherein each of the piston rods is tubular for directing a pressurized fluid into the cylinders.

14. The crimping tool of claim 13, further comprising a control unit for selectively delivering a pressurized fluid to each of the cylinder-piston arrangements via the tubular piston-rods.

15. The crimping tool of claim 14, wherein the control unit is functionally coupled with the pressing device.

* * * * *